United States Patent [19]

Miller

[11] 4,037,902

[45] July 26, 1977

[54] HERMAPHRODITIC MULTIPLE CONNECTOR PLUG

[75] Inventor: Sheldon M. Miller, Tulsa, Okla.

[73] Assignee: Tesco Engineering Company, Tulsa, Okla.

[21] Appl. No.: 667,406

[22] Filed: Mar. 16, 1976

[51] Int. Cl.[2] ..... H01R 25/10

[52] U.S. Cl. ..... 339/49 R; 285/70; 285/314; 339/89 M; 339 /113 R

[58] Field of Search ..... 339/47 R, 47 C, 48, 339/49 R, 89 R, 89 C, 89 M, 90 R, 90 C, 113 R; 285/23, 70, 314

[56] References Cited

U.S. PATENT DOCUMENTS

| | | | |
|---|---|---|---|
| 1,044,183 | 11/1912 | Irwin | 285/70 |
| 2,987,691 | 6/1961 | Ross | 339/49 R |
| 3,440,596 | 4/1969 | Frompovicz | 339/49 R |
| 3,855,566 | 12/1974 | Richardson | 339/49 R |

OTHER PUBLICATIONS

Hughes, Ruf-Nek Connector Manual, Hughes Aircraft Co., 2/72.

*Primary Examiner*—Roy Lake
*Assistant Examiner*—Mark S. Bicks
*Attorney, Agent, or Firm*—Daniel Silverman

[57] ABSTRACT

An improved hermaphroditic multiple connector plug having a front or mating end, and a back or cable end, comprising a cylindrical body having a contact assembly, including means to support a plurality of electrical contacts. The contact assembly surrounds and is sealed to the body, and has projections adapted to mesh with the corresponding projections on the contact assembly of a mating plug, so as to relatively index the two plugs and their contacts. The plug has a cylindrical tubular locking ring with diametrically disposed extensions which mesh with the extensions of the locking ring on a mating plug. There are sloping grooves and ridges on the projections so that as the locking ring is rotated clockwise with respect to a locking ring on a mating plug, the two plugs will be pulled and locked together. When the locking rings are turned counterclockwise with respect to each other, cam surfaces on the ends of the projections act to unlock and separate the two plugs.

10 Claims, 10 Drawing Figures

HERMAPHRODITIC MULTIPLE CONNECTOR PLUG

BACKGROUND OF THE INVENTION

This invention lies in the field of electrical connector plugs. More particularly, it lies in the field of hermaphroditic connector plugs. Still more particularly is lies in the field of high density connector plugs having a great multiplicity of electrical contacts.

Still more particularly it concerns a type of electrical connector plug in which a locking ring is provided to cooperate with a corresponding ring on a mating plug to coaxially pull together and lock the two plugs. The locking rings are also adapted to coaxially separate the two plugs.

Still more particularly this invention concerns high density connector plugs in which a quarter turn of the locking ring will pull together and lock two mating plugs, while a one third turn in the opposite direction will unlock and separate the two plugs.

In the prior art there have been high density connector plugs having many contacts. However, these have generally involved the use of a locking ring which has internal threads which correspond to those on the body of the second mating plug, and requires many revolutions of the locking ring to pull the two plugs together. When the locking ring is unscrewed, there is no way to pull the two plugs apart, because of the friction of the contacts, except to wiggle the parts laterally, while pulling. This tends to bend the contacts, so that on successive closures the force required to close and open the plug becomes very great. Also, this constant wiggling causes the contacts to break, and so on.

Furthermore, with the prior art plugs, since each plug has a clamping ring, and since the ring on one plug couples to the body of the other plug, it becomes necessary to thread one coupling ring far back on the body before the other ring of the other plug can be threaded.

Also, since the plugs are heavy, and are generally attached to heavy stiff cables, it is difficult with only two hands to hold the two parts in coaxial alignment while rotating the coupling ring many revolutions. This means that the hand that rotates the ring must ungrasp the ring and must move to a new position to regrasp it, during which time there is no way of supporting the first plug and the clamping ring, until the clamping ring has been advanced at least one complete turn.

SUMMARY OF THE INVENTION

It is a primary object of this invention to provide an hermaphroditic electrical contact plug having means to angularly index the two mating ends of two bodies when two plugs are to be connected.

It is a further object of this invention to provide a plug having a locking ring constrained to a selected angle of rotation about the body of the plug, and having two projections less than 90° in circumferential width, whereby as two plugs are mated, the locking ring projections on one plug will mesh with the locking ring projections on the other plug.

It is a still further object of this invention to provide a plug in which the locking rings on each body pull in the bodies and lock them together with a clockwise rotation of the locking rings.

It is a still further object of this invention to provide locking rings which,, with relative clockwise rotation of less than 90° will close and lock the plugs, while with a counterclockwise rotation of less than 120° they will unlock and separate the plugs. 120°

It is a still further object of this invention to provide a plug having four groups of contacts each in a quadrant of the contact assembly, opposite quadrants being male contacts and the other quadrants being female contacts. The contacts are supported in perforations in transverse webs between two diametral bars. Space is provided on the edge of the bars to mark the rows and columns of contacts in terms of letters and numbers respectively.

It is a still further object of this invention to provide exposed contact means on the exterior of each plug body, whereby appropriate clips can be attached thereto, and thus be connected to selected conductors in the cable.

These and other objects and advantages of this invention are realized and the limitations of the prior art are overcome by having a cylindrical body having a neck, including a packing gland into which the cable is clamped and sealed. At the mating end of the body of the plug a contact assembly is fastened and sealed, into which the contacts are positioned and sealed. There are two thinwalled cylindrical extensions, or projections, to the contact assembly which projections are each 90° in circumferential width and are circumferentially spaced. These projections mesh with the corresponding spaced between the projections on the contact assembly on a mating plug. Since the projections are substantially 90° in circumference, they index the two plugs. One projection has a secondary index which permits the two plugs to mesh in only one precise alignment axially. Alignment of the plug bodies also aligns the contacts.

A locking ring in the form of a cylindrical tube is adapted to rotate through a selected angle with respect to the plug, and is guided so as to have very little longitudinal motion. There are two projections on the locking ring, diametrically positioned, and greater than 90° in circumferential width. When two plugs are coaxially aligned, the projections on one locking ring move into the spaces between the projections of the other locking ring.

There is a sloping groove on the inside surface of one extension near the outer end, and on the outside surface of the other extension, leaving corresponding ridges at the ends of the projections. The ridge on one projection is adapted to slide in the groove of the other projection on a mating plug, and because of the slope of the grooves, they act as a single thread or cam, which, when the locking rings are rotated clockwise with respect to each other, through a quarter revolution, they act to pull the two plugs together, causing the contact to mesh.

For separating the two plugs, that is, for pulling the male contacts from the female contacts, cam surfaces, comprising sloping surfaces are cut on the ends of the projections. These surfaces slope in such a way that by counterclockwise rotation of the locking rings the cam surfaces interact to separate the locking rings and the plugs.

Inasmuch as the material of which the plug is constructed is plastic, it is convenient to provide a pair of electrodes on the exterior of the plug to which geophone jumper cables can be connected by means of clips.

BRIEF DESCRIPTION OF THE DRAWINGS

These and other objects and advantages of this invention and a better understanding of the principles and details of the invention will be evident from the following description taken in conjunction with the appended drawings; in which.

DESCRIPTION OF THE PREFERRED EMBODIMENT

Figure 1:
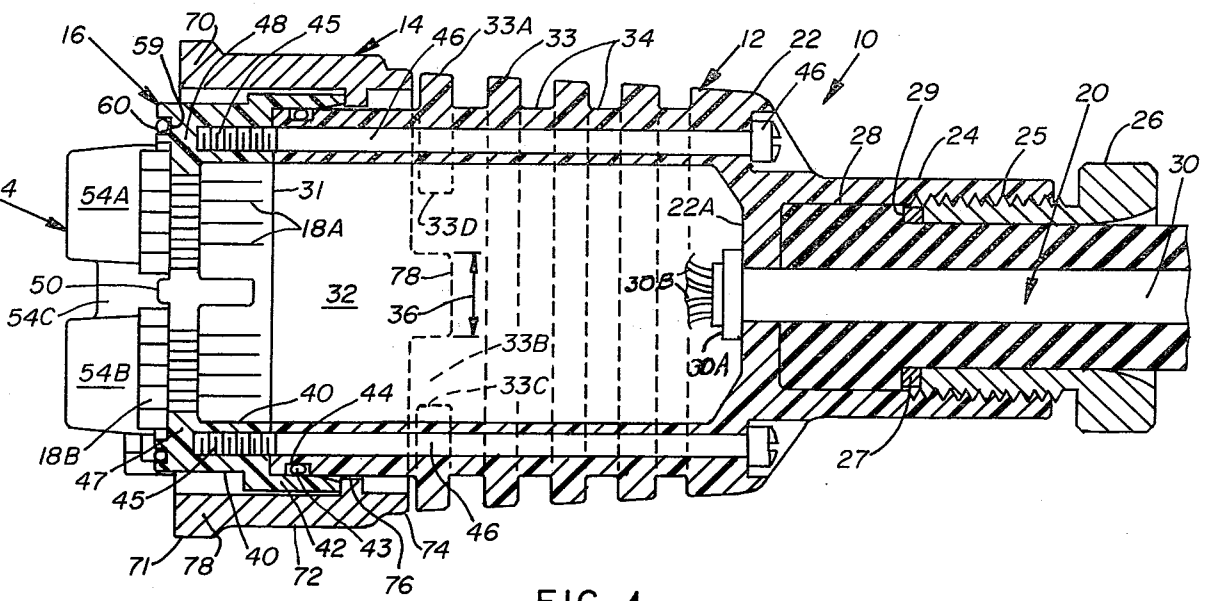
FIG. 1 illustrates a diametral cross sectional view of the plug.
Figure 2:
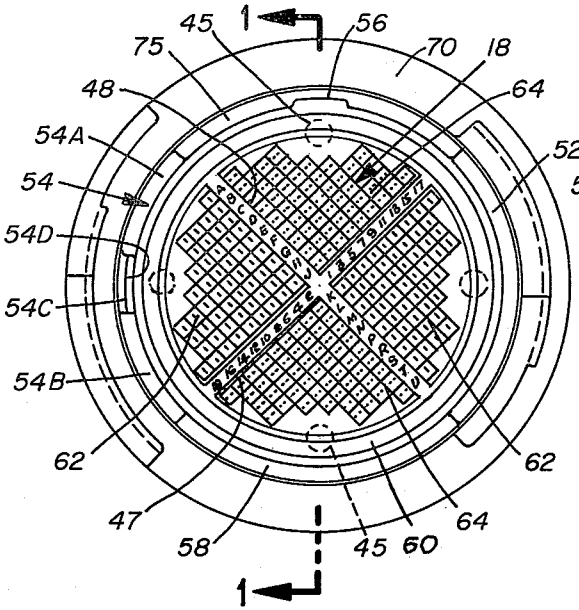
FIG. 2 illustrates an end view of the plug showing the electrical contacts.

Referring now to the drawings and in particular to FIGS. 1 and 2, there are shown a diametral section of the plug in FIG. 1 and an end view of the contact end, in FIG. 2. The plug indicated generally by the numeral 10 has a cylindrical shell body 12, and includes a contact assembly 16 that is clamped and sealed to the end of the body, and an encircling locking ring 14.

The body 12 is composed of a cylindrical shell 22, that tapers down to a neck portion 24, having a packing gland in its end. The cable, indicated generally by the numeral 20 has a plurality of conductors 30B with an outer jacket 30 to which is molded a locking flange 30A which prevents the cable from being pulled out of the plug. A rubber molded handle 28 is slipped over the cable, which fits snugly into the packing gland. There is a shoulder 29 against which a threaded packing nut 26 presses, through an intermediate metal ring 27. By means of threads 25, the packing nut 26 is tightened, compressing the handle against the jacket so as to seal against water leakage into the interior space 32 of the body.

At the open end of the body 12 is a contact assembly 16. This includes a thick ring portion 40 which abuts the end of the body at the surface 31. There is a cylindrical extension 42 which fits the outer surface of the body, and is sealed thereto by means of an "0" ring 43 placed in a groove 44. The contact assembly is ridigly held to the body by means of a plurality of long screws or bolts 46 cooperating with threaded holes 45 in the contact assembly.

As shown more clearly in FIG. 2, the contact assembly has two diametral bars 47, 48 having an enlarged central crossing portion 50. The contacts indicated generally by the numeral 18 are made in the form of square plastic assemblies which are fitted into the perforations in the transverse webs in the quadrants between bars 47 and 48, and are locked and sealed by means of suitable sealant, as is well known in the art.

Since this is an hermaphroditic plug, it contains equal numbers of male and female contacts, which are arranged symetrically in the contact ring. As will be explained below, the plug has indexing means, so that when two plugs are connected they are positioned 90° from each other. Therefore, it is convenient to place male contacts in opposite quadrants, and female contacts in the intermediate quadrants. Therefore, when the ends of the two plugs are abutted coaxially, and one plug is rotated 90° with respect to the other, male and female contacts are meshed.

As shown in FIG. 1, the contacts 18A extend substantially to the inner end of the contact assembly, so that when the contact assembly is removed from the body, the contacts 18A are exposed and the conductors 30B in the space 32 (which, incidently, are substantially longer than the length of the body) can be attached, such as by wire wrapping, or soldering, to the contacts.

Also, as shown in FIGS. 1 and 2, the female contacts 18B, 64 are extended above the bars 47, 48 so as to protect the extended male contacts.

Each of the contacts 18 must be identified by means such as a number. Since there may be as many as 200 or more conductors in the cable, (and corresponding contacts) there is very little space available for labeling. It is convenient, therefore, to provide a coordinate system of indexing, in which rows and columns of contacts are indicated by numbers and/or letters, as shown in FIG. 2.

With such a great number of contacts, it is extremely important that the two plugs be precisely indexed, so that when they are abutted coaxially, and pulled together, the contacts will mesh precisely.

The contact assembly 16 has two projections 52, 54. These are portions of a cylindrical shell, each are 90° in circumference and are diametrically opposite each other so that a corresponding pair on a meshing plug will fit in the spaces 57, 58 between the two projections 52, 54.

As shown in FIG. 2, one projection 54 has 2 wing portions 54A and 54B with a thinner, shorter portion 54C in between. In the space 57 is a ridge 56 that corresponds to the groove 54D. Part 54C is made shorter so that it is readily identifiable. So, when indexing two plugs, the part 54 is looked for, with its short central portion 54C. The corresponding part of the second plug is found, and is inserted in the space 90° clockwise from 54 of the first plug. The projections 52, 54 are slightly tapered so that they can be meshed at the tips quite easily. But, as the plugs are pulled together, they fit more tightly and precisely index the contacts.

As shown in FIGS. 1 and 2, at the outer edge of the contact ring 16 is a circular groove 59, into which is fitted an "0" ring 60. Thus, when two plugs are meshed, the two "0" rings will be in contact and will seal the contact assembly against entry of moisture.

Surrounding the outer end of the body 12 and the contact assembly 16 is a locking ring 14. It is held loosely between the end 42 of the contact assembly, pressing on the internal flange 76, and the end 74 of the locking ring pressing against the circumferential ridge 33A. As will be described more completely in connection with FIGS. 3 and 4, on the end edge 74 of the locking ring is an extension or ear 78, of dimension 36 that fits into a space 33B in the ridge 33A. The space 33B has two edges 33C and 33D spaced apart so as to permit a selected angle of rotation of the locking ring 14.

Figure 3:
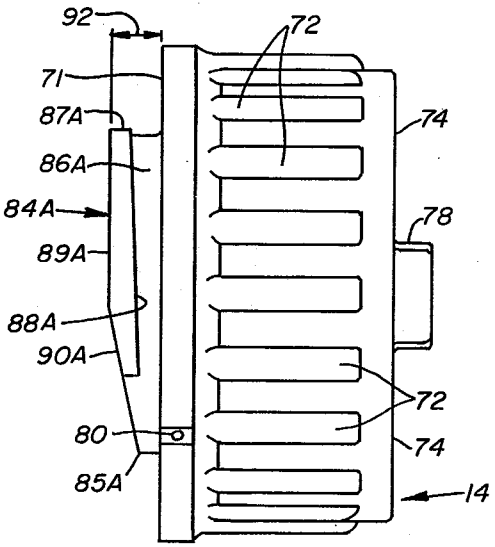
FIGS. 3 and 4 illustrate an external view and a cross sectional view of the locking ring.
Figure 4:
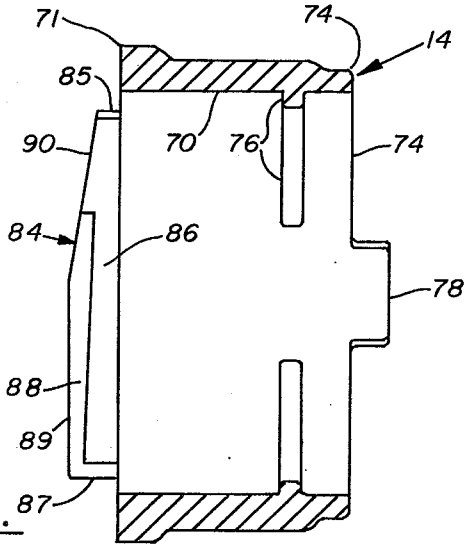
Figure 5:
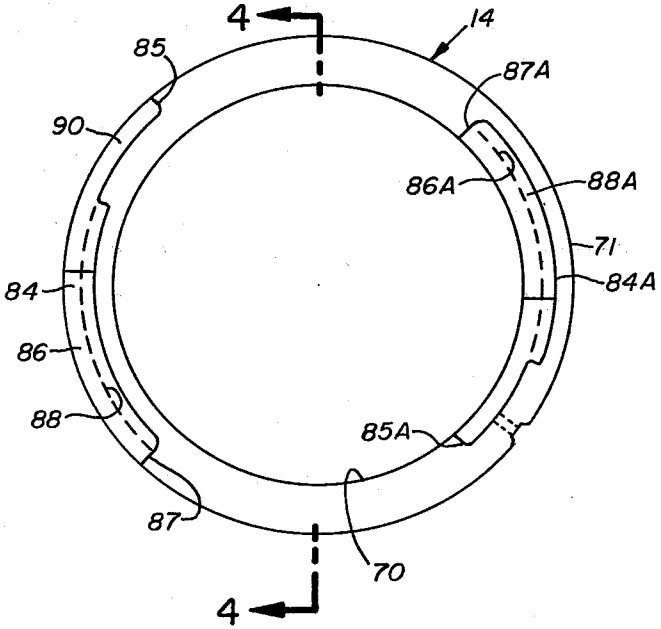
FIG. 5 illustrates an end view of the locking ring.

Referring now to FIGS. 3, 4 and 5, there are shown views of the locking ring 14. FIG. 3 shows an external view, while FIG. 4 shows a cross sectional view. There is a cylindrical body portion 70 which may have longitudinal ridges 72 to enable a better hand grip on the outer surface. There is a back edge 74 with the previously mentioned projecting ear 78. There is a thicker surface 71 at the front edge. The front edge 71 has 2 cylindrical projections 84 at its outer surface, and 84A at its inner surface. These are shown more clearly in FIG. 5. The thickness of the walls 86, 86A of the projections 84, 84A is less than half the width of the edge 71, so that they can pass each other, when a coupling ring on one plug is meshed with a corresponding ring on a meshing plug.

At the outer edge of the projection wall is a ridge. On 84 the ridge 88 extends inwardly, while on the extension 84A the ridge extends outwardly.

Looking at these extensions another way, and considering that the thickness of the extension is greater than one half the width of edge 71, it can be considered that there are grooves 86, 86A cut in the appropriate surfaces, leaving ridges 88 and 88A. The grooves are tapered between the sloping edge of the ridge and the plane surface of the edge 71.

The projections are slightly greater than 90° in circumference, although this dimension is not critical. Looking at them as in FIG. 5, and moving clockwise, the first, leading edge 87 rises to the maximum dimension 92 of the projections. The top surface remains flat 89, 89A for approximately 45° and then slopes linearly down 90, 90A to a longitudinal dimension about half of 92. Because of the short trailing edge 85, 85A due to the cam slope 90, the ridge 88 is short at this end.

Figure 7:
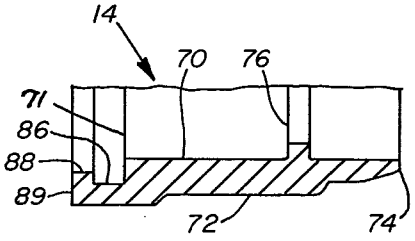
FIG. 7 is a partial cross section of the locking ring taken through one projection.

FIG. 7 illustrates a cross section of the locking ring taken through a projection showing surface 89, ridge 88, groove 86, and surface 71.

Figure 8:
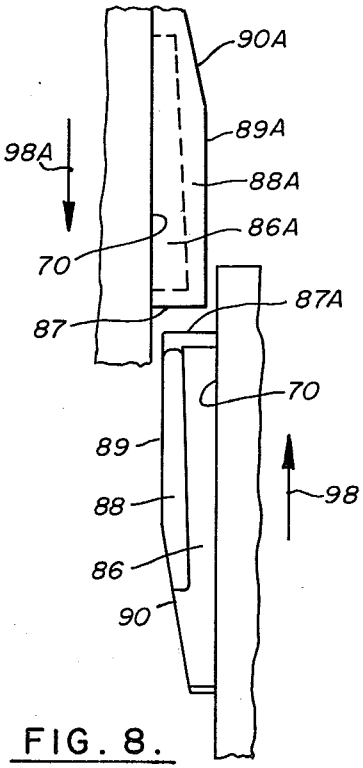
FIG. 8 illustrates the locking action of the locking ring.

FIG. 8, illustrates the meshing of the interior ridge 88A into the exterior slot 86, and the exterior ridge 88 into the interior slot 86A.

At the start, these meshing ridges and slots (or cams 86, 86A) mesh at the starting edges 87, 87A, then as the locking rings are rotated clockwise with respect to each other, according to the arrows 98, 98A, they begin to pull the locking rings together, and with them, the plugs.

The slots 86, 86A are intentionally made wide, so that no difficulty is experienced in getting the ridges meshed therein. Then, as rotation of the locking rings progresses, the plugs are pulled together until surfaces 71 are in tight contact.

Of course, the slots and the ridges which mesh could be made of precise shape of threads, as is done on conventional plugs. However, such coupling rings as used on conventional plugs are tightened generally after the plugs are pressed together by hand. Even so, it is very difficult to get the threads started.

In this plug, because of the great friction due to the great number of contacts, the contacts are not meshed when the coupling ring is being meshed. Therefore, it would be difficult to accurately coaxially align the two plugs to get the threads aligned and started. Consequently, threads are not used, but cam edges are provided, with wide grooves, so that meshing is very simple, even if the plugs are not precisely aligned.

If threads are used, it would be possible to partially separate the plugs and contacts by simply reversing the rotation of the coupling ring. However, with the wide grooves this is not possible. Consequently the outer edges 89 of the projections are formed with cam slopes 90. By counterclockwise rotation of the locking rings, the cam surfaces come into play and separate the plugs.

FIG. 8 is shown in schematic fashion, with the curved surfaces of the extension extended into planar form. In this way the plugs are locked by sliding the extensions 84 in the direction of the arrows 98, 98A. This corresponds to clockwise rotation of the locking rings with respect to each other. A turn of about 90° is required to close and lock the plugs.

Figure 6:
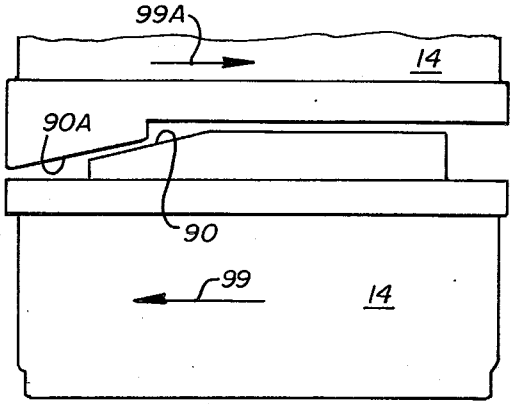
FIG. 6 is a schematic view illustrating the unlocking action of the locking ring.

The action of unlocking is illustrated in FIG. 6, which shows the locking rings unmeshed, but the plug contacts still meshed. Another 30 degrees of counterclockwise rotation in the direction of arrows 99, 99A will cause the two pairs of cam surfaces 90, 90A to press the two plugs apart, until the contacts are separated. In operation, it will be clear that approximately 90° clockwise rotation of one locking ring with respect to the other will close and lock the plugs. A 90° counterclockwise rotation of one locking ring with respect to the other will unlock the two locking rings (as shown in FIG. 6) and an additional 30° of counterclockwise rotation will separate the contacts. In this embodiment the locking ring of one plug meshes with and locks to the locking ring of the mating plug.

It is well known that in the use of two ramp cams for separating two bodies in a direction perpendicular to the direction of motion of the cams, (and in the use of screw threads) the flatter the ramp, that is, the smaller the ramp angle, the less the required force on the cams to cause a separaton of the bodies. Thus, the ramp angle of the cam surfaces is kept as small as possible, considering the minimum longitudinal movement required to separate the contacts, and the allowable angle of rotation of the cams of more than 30°.

In the prior art, the locking ring of one plug meshed with the body of the mating plug. While the circumferential width of the extensions 84 is greater than 90°, the circumferential length of the ridges 88 (because of the sloping surfaces 90) is less than 90° so that there is no problem to mesh the opposing extensions of the locking rings of two meshing plugs, even before the contacts start to mesh.

Figure 10:
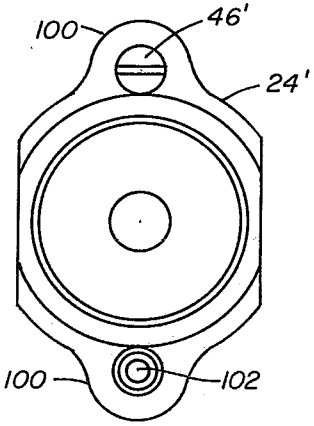
FIGS. 9 and 10 show two views of the cable end of the plug illustrating the exterior electrodes.
Figure 9:
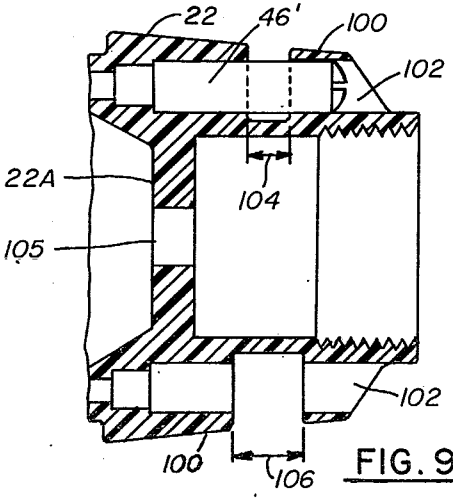

In FIG. 1, the cable end of the body 22 is shown reduced to a neck portion 24. In FIGS. 9, 10 are shown two views of a modification of this construction.

There are 4 bolts 46 positioned at 90° that project through openings 45A and are threaded into tapped holes 45 in the contact assembly. These bolts 46 are fully insulated from the cable conductors and contacts.

In the embodiment of FIGS. 9 and 10 two ribs 100 are formed on opposite sides of the neck 24, surrounding opposite openings for bolts 46. These are formed with a bored opening 102, of the size of the enlongated head of the bolt 46'. Slots 104, 106 are cut across the ribs 100, each of different width, so that contact clips of comparable width can be pressed onto the bolts 46'. Contact is made to the bolts 46' internally from two selected conductors in the cable through appropriate openings in the inner wall of the body.

It is conventional practice in fabricating seismic cables to cut into the jacket at selected points along the cable to attach leads, and to mold contacts on the outside of the cable which are attached to these leads. Clips are then pressed onto the contacts so as to connect with the selected conductors. By the method of FIGS. 9 and 10 such contact to conductors in the cable can be made at the plug, without having to cut into, and weaken, the cable jacket.

While two ribs are shown, it will be clear that as many ribs can be provided as there are bolts, and any desired number of bolts can be provided, connected to selected conductors in the cable.

In review, a plug has been described which has a high density of contacts, half male and half female. The plug has a cylindrical body, and has attached to the body at the mating end a contact assembly. The contact assembly is held to the body by means of a plurality of longitudinal bolts inserted in openings through the body and tapped into the contact assembly.

The contact assembly has two diametral projections in the mating end, which mesh in only one angular collinear position with the projections of a contact assembly on a meshing plug. When the contact assembly projections of two plugs mesh, the contacts also mesh. The contact ring is sealed to the body by means of 0 rings.

The plug has a cylindrical locking ring surrounding the contact assembly, and having limited angular rotation around the plug. The locking ring has two diametrically disposed projections which mesh with corresponding projections on the locking ring of a matching plug.

There are sloping grooves and ridges on the projections which mesh with those on the projections on a meshing plug, whereby relative clockwise rotation of one ring with respect to the other ring of about 90° will cause the two plugs to be pulled together and sealed.

There are two sloping surfaces on the counterclockwise ends of the projections, such that when the meshed locking rings are turned 90° counterclockwise with respect to each other the grooves and ridges will be unmeshed, unlocking the plugs (although the contacts will still be meshed) while turning them counterclockwise another 30° will cause the two cam surfaces to engage and pull the plugs apart.

The contact assembly comprises a pair of diametral bars at 90° inside of a cylindrical ring, with transverse webs in each quadrant. There are a plurality of circular openings through the webs arranged in rows and columns with respect to the bars. Letters and numbers are engraved on the edges of the bars identifying the rows and columns of the openings.

The contacts are commercial, over the counter items, manufactured by Terradyne Components Inc. 600 Lawrence Ave, Lowell, Mass. 01852. The contacts are housed in small plastic assemblies having a square exterior at one end and a round exterior at the other end. These assemblies are pressed into the openings in the web, male contacts in opposite quadrants and female assemblies in the intermediate quardrants. Since the male contacts extend beyond the square ends a distance D, the web supporting the male contacts is depressed this distance D to protect the male contacts.

After the contact assemblies are pressed into the webs, the interior of the assembly is sealed with suitable sealant in the interstices.

Means are provided for extending the bolts which hold the body and the electrode assembly together. These bolts have elongated heads and are covered with longitudinal ridges which are longitudinally bored for the bolts. Each of the ridges has a transverse channel cut across the ridge, each of different width, to expose the bolt head. This permits the attachment of a spring clip to the bolt head. Inside the body selected conductors are attached to the bolts. Since the body is molded of insulating material, this makes it possible by clips to contact two, four, or more conductors in the cable connected to the plug.

While the invention has been described with a certain degree of particularity, it is manifest that many changes may be made in the details of construction and arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed:

1. In a high density hermaphroditic electrical connector plug adapted to couple and mesh with an identical meshing plug comprising;

a. said electrical connector plug having a cable end and a meshing end, the cable end connected to a multi-conductor cable;

b. said electrical connector plug comprising;

1. a cylindrical body;
2. a unitary cylindrical sealed contact assembly means attached and sealed to said body to support a plurality of electrical contacts inside said contact assembly means;
3. said contact assembly means of said electrical connector plug having two circumferentially spaced projections in the meshing end, which mesh in only one angular colinear position with the projections of an identical contact assembly means on said identical meshing plug, and wherein when said contact assembly means projections of said electrical connector plug and said meshing plug are meshed, the electrical contacts of said electrical connector plug and said meshing plug are also meshed;

the improvement in means to lock and unlock said electrical connector plug and said identical meshing plug, comprising;

c. a cylindrical locking ring on said electrical connector plug surrounding said body and contact assembly thereof and adapted to mate with a similar locking ring on said identical meshing plug;

d. means to permit rotation of said locking ring on said body of said electrical connector plug through a selected angle;

e. means to substantially prevent relative longitudinal motion of said locking ring and said body on which it is mounted;

f. first and second circumferentially spaced projection on the meshing end of said locking ring;

g. a single sloped groove in the inside surface of said first projection forming a first ridge on the inside end of said first projection, and on the outside surface of said second projection, forming a second ridge on the outside end of said second projection, said first ridge on said first projection of said locking ring of said electrical connector plug adapted to fit into a groove of a second projection, of said locking ring on said identical meshing plug, and vice versa;

whereby as said locking ring on said electrical connector plug is rotated clockwise with respect to said locking ring on said meshing plug, said ridges will slide in the corresponding grooves, and because of the slopes of the grooves, the two locking rings will be pulled together, and with them said electrical connector plug and said meshing plug; and wherein said electrical connector plug includes the further improvement comprising;

h. a first longitudinal edge of said projections on said locking rings of said electrical connector plug and said meshing plug being the leading edge where said ridges and said grooves first mesh;

i. the ends of said projections cut perpendicular to the axis of said locking rings, at said leading edges;

j. the ends of said projections cut at a selected small slope angle to said perpendicular to the axis of said locking rings at the trailing edges of said projectons;

k. whereby, after rotating said locking rings of said electrical connector and meshing plugs in a clockwise direction and said two plugs are pulled together, as said locking rings are rotated counter clockwise with respect to each other, said sloping ends of said projectons will slide, one on the other, and will pull apart said locking rings and with them said electrical connector plug and said meshing plug.

2. The electrical connector plug as in claim 1 including a circular groove in the meshing end of said contact assembly means surrounding said contacts of said electrical connector plug, and an "0" ring in said groove;

whereby when said electrical connector plug and said meshing plug are meshed and pulled together by said locking rings, said "0" ring in said electrical plug connector contact assembly means will press on an "0" ring in the meshing plug contact assembly means and will seal the contacts from water entry between said two contact assembly means.

3. The electrical connector plug as in claim 1 in which said contact assembly means includes a cylindrical tubular protion having;

a. two diametral bars perpendicular to each other; and b. transverse webs in the quadrants between said diametral bars, said contacts in perforation in said webs.

4. The electrical connector plug as in claim 3 including sealant means to seal the contacts through the webs in said contact assembly means.

5. The electrical connector plug as in claim 3 in which said contacts are mounted in elongated plastic assemblies, square on one end and round on the other end; and including a plurality of circular openings in said webs adapted to receive the round portion of said contact assemblies.

6. The electrical connector plug as in claim 5 in which the electrical contact of the male contacts extends above the ends of the square plastic assemblies a distance D, and including the web supporting the male contacts being depressed below the position of the web supporting the female contacts by said distance D.

7. The electrical connector plug as in claim 3 in which the thickness of said perpendicular diametral bars is great enough to permit placement of alphanumeric indicia on the edges of said bars, marking the rows and columns of the contacts in the quadrants between said bars.

8. The electrical connector plug as in claim 1 in which said contact assembly is held to and sealed to said body by a plurality of longitudinal bolts through the wall of said body.

9. The electrical connector plug as in claim 8 including at least two longitudinal ridges on the outside of said body near the cable end, enclosing said bolts, a groove cut across each of said ridges, of selected different widths, and bolts having elongated heads placed in the openings through said ridges;

whereby the elongated heads of said bolts are exposed in said grooves.

10. The electrical connector plug as in claim 1 in which the slope angle at the trailing edges of said projections is under 45°.

* * * * *